United States Patent [19]

Bec et al.

[11] Patent Number: 4,826,359

[45] Date of Patent: May 2, 1989

[54] STRUCTURES OF COMPACTED MATERIALS COMPOSED OF EMBANKMENT FIXED WITH A HYDRAULIC BINDER AND PROCESSES AND MACHINES FOR CONSTRUCTING THEM BY COMPACTING THE SLOPES

[75] Inventors: André G. Bec, Clermont L'Herault; Jean-Pierre R. Martin, Montpellier; André L. Blanc, Belin, all of France

[73] Assignee: "BEC FRERES S. A.", Saint Georges D'Orques, France

[21] Appl. No.: 111,443

[22] Filed: Oct. 21, 1987

[30] Foreign Application Priority Data

Nov. 20, 1986 [FR] France ..... 86 16297

[51] Int. Cl.[4] ..... E02D 3/02

[52] U.S. Cl. ..... 405/271; 37/105; 404/133; 405/258

[58] Field of Search ..... 405/271, 258, 263; 404/127, 133; 37/117.5, 105, DIG. 3; 172/40

[56] References Cited

U.S. PATENT DOCUMENTS

| | | | |
|---|---|---|---|
| 2,899,329 | 8/1959 | Lyons | 405/263 |
| 3,131,074 | 4/1964 | Thompson | 405/263 X |
| 3,146,686 | 9/1964 | Grace et al. | 404/127 |
| 3,682,101 | 8/1972 | Plasser et al. | 37/105 |
| 4,489,658 | 12/1984 | von Beckmann | 37/105 X |

FOREIGN PATENT DOCUMENTS

| | | | |
|---|---|---|---|
| 0721495 | 3/1980 | U.S.S.R. | 404/127 |

*Primary Examiner*—Dennis L. Taylor

*Attorney, Agent, or Firm*—Balogh, Osann, Kramer, Dvorak, Genova & Traub

[57] ABSTRACT

This invention relates to a machine for constructing structures composed of several superposed layers of embankment mixed with a hydraulic binder, machine comprising a self-propelled chassis bearing two vibrating rammers: a first inclined rammer which compacts the slope of each layer and a second horizontal rammer which, at the same time, compacts a horizontal strip of said layer lying along the upper edge of the slope.

12 Claims, 5 Drawing Sheets

STRUCTURES OF COMPACTED MATERIALS COMPOSED OF EMBANKMENT FIXED WITH A HYDRAULIC BINDER AND PROCESSES AND MACHINES FOR CONSTRUCTING THEM BY COMPACTING THE SLOPES

FIELD OF THE INVENTION

The present invention relates to structures of compacted materials composed of embankment mixed with a hydraulic binder, and to processes and machines for constructing such structures in successive sections by compacting the slopes of each section.

The technical sector of the invention is that of constructing structures of compacted embankment, particularly hydraulic structures.

BACKGROUND OF THE INVENTION

It is known to construct structures of embankment mixed with a hydraulic binder, material which is currently designated by the term roller-compacted concrete.

For example, hydraulic structures such as dams or retaining dykes are constructed with this material.

The hydraulic binder may be cement, lime, blast furnace slag, ashes rejected from thermal stations, pozzuolana, etc. . . or mixtures of these materials in any proportions.

After the hydraulic binder has hardened, this material presents good mechanical qualities, and in particular a good cohesion which makes it possible to produce very steep slopes, much steeper than the natural slope of the non-bound embankment, and substantially to reduce the volume of the structures.

The structures of embankment enriched with a hydraulic binder are constructed in successive layers which are compacted by a heavy compactor which moves over each layer.

The problem to be solved is the treatment of the slope.

The slope may be allowed to take its natural inclination without compacting it. However, in that case, the slope is not watertight and is not suitable for forming the face of a hydraulic structure in contact with water. Neither is such a slope suitable for the other face of the structure which is eroded by rain water.

Up to the present time, the slopes are coated with prefabricated concrete elements or by casting behind a shuttering or in a sliding form a wall of concrete forming a protective skin which responds to the technical and aesthetic requirements of the structure.

Such solutions are expensive.

It is an object of the present invention to provide means for compacting the slopes of the successive sections of a structure of embankment enriched with a hydraulic binder in order to obtain a closed wall, able to have an inclination greater than that of the natural slope and even close to the vertical.

The compacting of an embankment slope which limits a layer of compacted material raises a problem in that the operation of compacting of the wall of the slope causes upward unpacking of the materials.

Furthermore, the upper edge of the slope before compacting of the slope is generally very irregular and such irregularity must be eliminated.

It is an object of the present invention to provide means for compacting the slopes of a structure of embankment mixed with a hydraulic binder without unpacking the materials located in the volume defined by the slope and the horizontal surface of each layer and which make it possible to obtain a regular upper edge of the slope.

Manufacture of structures composed of successive horizontal layers of compacted material raises the problem of compacting of the horizontal surface located near the edge of the slope, since the compacting machines cannot roll too close to the slope without danger.

Another object of the present invention is to provide means for compacting the slopes which solve this difficulty.

The processes according to the invention for constructing structures of a compacted material composed of embankment mixed with a hydraulic binder comprise, in known manner, the following operations: spreading successive layers of material, levelling each layer and compacting it by means of a vibrating roller which rolls on said layer.

SUMMARY OF THE INVENTION

A process according to the invention is characterized in that each lateral slope of each layer and a horizontal strip of ground parallel to the upper edge of said slope are compacted simultaneously.

Simultaneous compacting is preferably effected by means of two vibrating rammers: one inclined rammer which compacts said slope over the whole height and a horizontal rammer which compacts said horizontal strip over the whole of its width.

Said vibrating rammers are advantageously fastened to an arm or a boom of a self-propelled machine which moves over each compacted layer recessed with respect to a lateral edge thereof and parallel to said edge.

The arm or boom which supports said rammers advantageously comprises means for returning it horizontally towards said machine and, after having brought the two rammers close to a natural, non-compacted slope, said rammers are returned towards said machine in order to repel the materials and ram them inside the dihedron between the two rams, this making it possible to obtain slopes having an inclination greater than that of the natural slope and a regular upper edge and to construct structures whose lateral walls present inward shoulders in the form of steps.

A machine according to the invention comprises two vibrating rammers, an inclined rammer which compacts the slope of each layer and a horizontal rammer which simultaneously compacts a horizontal strip of said layer located along the upper edge of said slope.

According to a preferred embodiment, a machine according to the invention comprises a self-propelled chassis equipped with an arm or a boom which bears a support composed of two branches, one horizontal, to which said horizontal rammer is fastened and the other inclined, to which said inclined rammer is fastened.

The two branches of said support are advantageously orientable with respect to each other, with the result that it is possible to adjust the inclination of said inclined branch in order to adjust the inclination of said slopes.

The vibrating rammers are advantageously fastened to said support via buffers.

According to a preferred embodiment, the rammers are vibrated by rotating vibrators with eccentric flyweights and the machine comprises means for adjusting the eccentricity of said flyweights and the speed of rotation of said vibrators which make it possible to adjust the amplitude and frequency of the vibrations as a function of the nature of the material to be compacted.

The invention results in structures of a compacted material composed of embankment mixed with a hydraulic binder which comprise slopes obtained by compacting and which have an inclination greater than the inclination of the natural slope, which may be close to the vertical.

In particular, the invention makes it possible to construct structures of compacted concrete of which the lateral slopes present inward shoulders in the form of steps.

Since they make it possible to construct slopes much more inclined than the natural inclination, the processes and machines according to the invention enable the volume of materials necessary for constructing the structures and the ground volume thereof to be reduced, without being detrimental to the stability of the structures.

The processes and machines according to the invention make it possible to obtain slopes of structures of compacted concrete which are watertight, which resist degradation by trickling water and by frost, and which have an aesthetic appearance, without having to cover the slopes with a water-tight coating or with slabs of prefabricated concrete.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
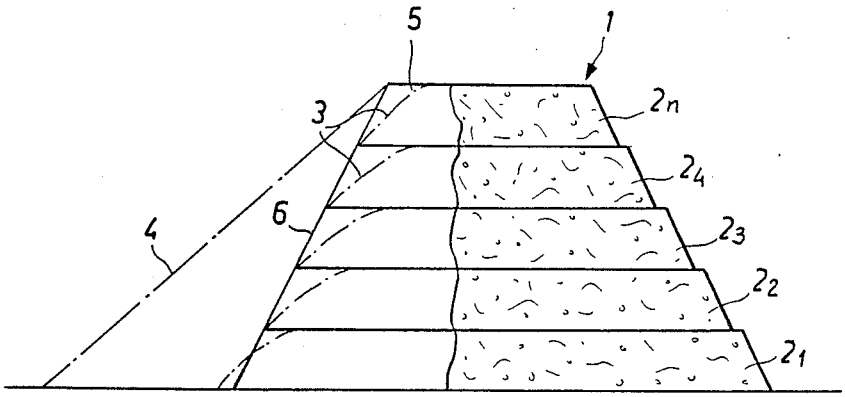
FIG. 1 shows a transverse section of a structure according to the invention.

Referring now to the drawings, FIG. 1 shows a structure 1 according to the invention which is, for example, a dyke, a dam or any other structure of embankment mixed with a hydraulic binder.

The proportion of hydraulic binder is relatively small, for example of the order of 50 to 150 kg/m$^3$ of embankment.

Such structures are known which are made in successive horizontal sections of small thickness, for example layers having a thickness of between 20 cm and 1 m.

FIG. 1 shows an example of a structure comprising n successive layers $2_1$, $2_2$, . . . 2n. Each layer is positioned by pouring the material in the unconsolidated state, then each layer is levelled and compacted by means of a compacting machine, generally a vibrating roller which rolls over the layer which has just been levelled.

During positioning of the embankment, the slopes laterally defining each layer are formed in an inclination 2 represented in dot-and-dash lines on the left of FIG. 1 which corresponds to the inclination of the natural slope generally less than 45°.

The problem to be solved is to produce the lateral faces of the structure.

One of the methods known at the present time for structures of embankment consists in making layers wider than the structure, in compacting them by means of a machine which rolls on each layer and, when the structure is finished, the lateral walls are cut along the desired slope, by removing the non-compacted embankment.

This method is not applicable to embankments enriched by a hydraulic binder, as the binder sets and it is no longer possible to cut the lateral walls when all the layers have been positioned. The ends of each layer might be cut, but this would involve high costs and would not allow very steep slopes.

Another expensive process consists in positioning slabs of prefabricated concrete on the slopes.

Another process consists in conserving lateral walls as natural, non-compacted slope. This solution is not valid for slopes of a hydraulic structure which are in contact with water.

Moreover, this solution leads to structures having a relatively small inclination of the slopes which therefore necessitate a much greater volume of materials than is necessary for the stability of the structure. The dashed and dotted line 4 of FIG. 1 represents for example what would be the shape of the natural slope of a structure having the same width at the top, which must be sufficient to allow passage of the machines.

Another problem to be solved for making the slopes resides in the fact that the upper part of the natural embankment slope has a more or less rounded form 5 as shown in FIG. 1 and therefore does not present a pronounced edge.

Another problem is illustrated in FIG. 1.

It is generally advantageous to make a finished slope 6 having an inclination greater than that of the natural slope 3 and the invention aims at providing processes for producing such a finished slope solely by compacting, one after the other, the slopes of each layer. Development of such a process raises a problem which is clearly apparent in FIG. 1.

When a layer and its slopes have been made and the loose material forming the following layer has been spread thereon, the natural slopes 3 represented in dashed and dotted lines in FIG. 1 leave from the peak of the slopes of the lower layer and are therefore recessed with respect to the profile of the finished slope.

The processes and machines according to the invention enable this deficit of material to be overcome, by making lateral faces which present a succession of elementary slopes slightly offset inwardly in the form of steps or berms, as shown in the right hand part of FIG. 1.

A process according to the invention for constructing a structure of compacted concrete, i.e. a compacted material composed of embankment mixed with a hydraulic binder, comprises the following operations of:

preparing the material by mixing an embankment with a hydraulic binder taken in proportions of between 50 kg/m$^3$ and 150 kg/m$^3$ for example. The granulometry of the embankment may vary between 0/10 mm and 0/150 mm;

making the structure by successive layers;

to make each layer: spreading the loose material over a thickness of between 20 cm and 0.70 m for example, levelling and compacting by means of a vibrating roller which rolls over the material which has just been levelled.

For safety reasons, the roller cannot go too close to the edge, with the result that a strip remains, parallel to each lateral edge, which is not well compacted. Moreover, such a compacting of the edge brings about unpacking of the embankment.

The operations set forth hereinbefore are known.

Once these operations have been carried out, the lateral slope of each layer and a horizontal strip parallel to the lateral edge of said layer which forms the upper edge of said slope are compacted simultaneously.

Figure 2:
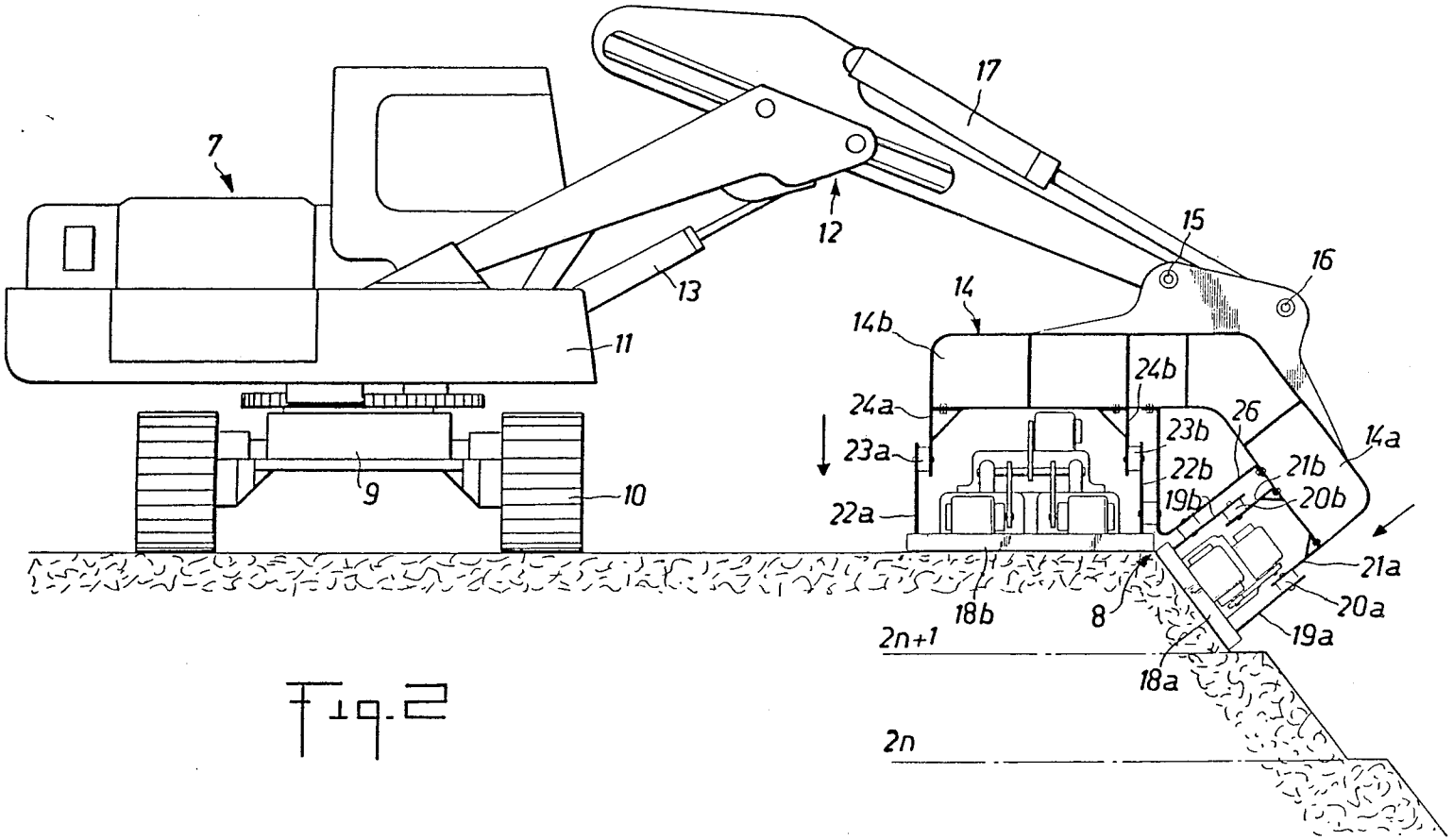
FIG. 2 is a view in elevation of a machine according to the invention in the course of compacting a slope.

FIG. 2 shows an embodiment of a machine for carrying out a process according to the invention.

FIG. 2 represents a terminated layer 2n and a layer 2n+1 in the course of compacting of a slope.

FIG. 2 shows a non-limiting example in which the slopes of the superposed layers are slightly offset inwardly to form a lateral surface comprising inward shoulders in the form of steps.

A machine according to the invention comprises a self-propelled machine 7 which moves over the layer 2n+1 parallel to a lateral edge 8 of the layer and some meters therefrom.

The machine 7 comprises a self-propelled chassis which is for example a mechanical shovel chassis 9, provided with crawlers 10 and equipped with a pivoting turret 11 bearing an articulated arm 12 moved by hydraulic jacks 13.

Of course, other self-propelled chassis may be used, for example a crane chassis provided with a pivoting boom.

The articulated arm 12 bears at its end a device according to the invention. This device comprises a support 14, which is connected to the arm by an articulation 15 and which is connected by an articulation 16 to the rod of a hydraulic jack 17 borne by the last section of the articulated arm, which jack makes it possible to adjust the position of the support 14. The support 14 is composed of two branches, a horizontal branch **14*b* which is displaced above a horizontal strip of ground lying along the edge 8 of the layer and an inclined branch 14*a*** which is displaced along the lateral embankment of the layer 2n+1.

FIG. 2 represents an embodiment in which the support 14 is in one piece, with the result that the obtuse angle formed by the two branches **14*a* and 14*b*** with respect to each other is determined by construction and corresponds to a determined, non-adjustable inclination of slope.

Figure 4:
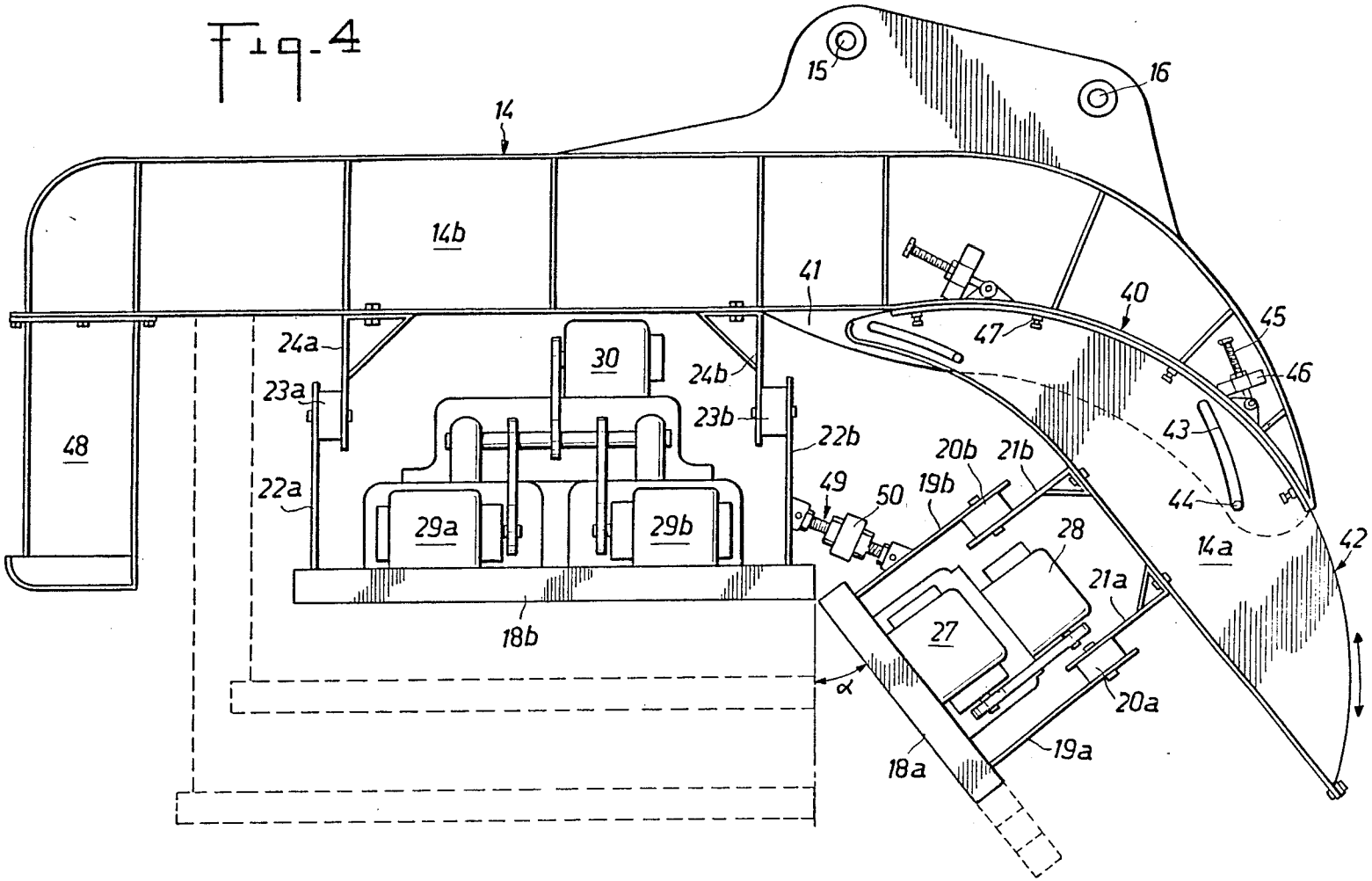
FIG. 4 is a view in elevation of a variant embodiment of the device bearing the vibrating rammers.

According to a variant embodiment shown in FIG. 4, the branch **14*a* is orientable, which makes it possible to adjust the inclination of this branch and of the rammer 18*a*** as a function of the inclination of the slopes which it is desired to obtain and which may vary between 45° and 90°.

A device according to the invention comprises two rectangular or square vibrating rammers **18*a* and 18*b***.

The vibrating rammer **18*a* is inclined and serves to compact the slope. It is fixed to two side elements 19*a* and 19*b*. Each side element 19*a* and 19*b* is connected by elastic buffers 20*a*, 20*b* of the "silent block" type to two side elements 21*a*, 21*b* which are fixed perpendicularly to the inclined branch 14*a*, with the result that the rammer 18*a* is parallel to branch 14*a***.

In the same way, the horizontal vibrating rammer is fixed to two vertical side elements **22*a*, 22*b* which are connected by elastic buffers 23*a*, 23*b* to two vertical side elements 24*a*, 24*b* which are fixed to the horizontal branch 14*b***.

Moreover, the side elements **19*b* and 22*b* abut on two elastic buffers 25*a* and 25*b* which themselves abut on a metal structure 26 which is fixed to the two branches 14*a* and 14*b* of the support 14 between the two rammers. The elastic buffers 25*a*, 25*b*** avoid the risk of the two rammers hitting each other.

Figure 3:
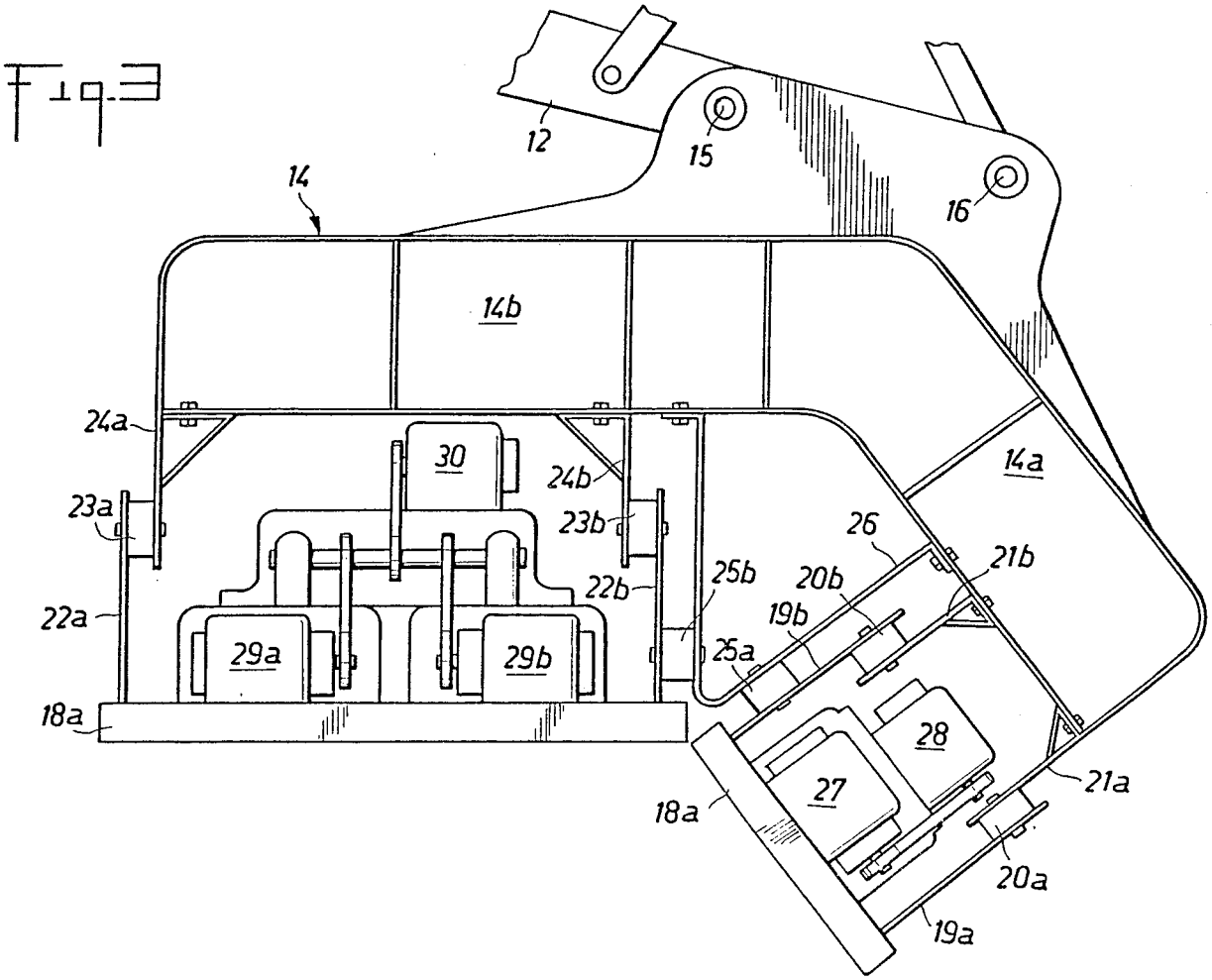
FIG. 3 is a view in elevation, on a larger scale, of the device of FIG. 3 bearing vibrating rammers.

FIG. 3 shows on a larger scale a support 14 according to FIG. 2. The same parts are represented by the same references in FIGS. 2 and 3.

The inclined rammer **18*a* is vibrated by a vibrator 27 with eccentric flyweights which is placed on the rammer and which is driven in rotation by a motor 28** which is preferably a hydraulic motor.

The horizontal rammer **18*b* is vibrated by two vibrators 29*a* and 29*b* with eccentric flyweights, which are driven in rotation by the same motor 30**, via pulleys and synchronous belts, with the result that there is no slide and the vibrations produced by the two vibrators are at the same frequency and in phase.

The rammers **18*a* and 18*b* are rectangular and have the same length, for example 1 meter. The width of inclined rammer 18*a* corresponds to the height of the slope. The width of horizontal rammer 18*b*** is of the order of twice the width of the inclined rammer.

FIGS. 2 and 3 show an embodiment in which the branches **14*a* and 14*b* of the support 14** have a length which corresponds to a determined width of rammers.

FIG. 4 represents a variant embodiment in which the branches **14*a* and 14*b* of the support 14 have a greater length and the side elements 21*a* and 24*a*** may be displaced with the result that it is possible to choose rammers of different width in order to adjust them to the height of the slopes.

FIG. 2 shows a stepped slope, each elementary slope having an inclination greater than that of the natural slip slope.

A machine according to the invention makes it possible to produce such a stepped slope in the following manner. After a layer of embankment has been positioned and compacted vertically, the lateral slopes have the natural inclination. The two rammers are brought close to the slope. The inclined rammer **18*a* is brought close to the foot of the slope and the rammers are drawn inwardly, using the articulated arm of the shovel, which has for its effect to push the material inside the obtuse dihedron formed by the two rammers until this dihedron is filled with material. The rammers are then vibrated in order to compact the slope and the horizontal strip simultaneously, with the result that a slope is obtained which presents a rectilinear and clearly marked peak 18**.

FIG. 4 represents a variant embodiment of a rammer support 14 according to the invention. The same parts are represented by the same references in FIGS. 3 and 4.

The embodiment of FIG. 4 differs from the one shown in FIG. 3 in that the support 14 is composed of two separate branches.

Branch **14*b* is fixed. Branch 14*a* is movable, with the result that it is possible to adjust its inclination and at the same time the inclination of the inclined rammer 18*a*** as a function of the inclination of the slope which may make an angle $\alpha$ with the vertical of between 0° and 90°.

The fixed branch **14*b* comprises, at its end, a surface 40 in the form of a sector of circle which is framed by two side elements 41. The mobile branch 14*a* has a circular upper face 42 with the same radius as the surface 40** against which it abuts.

Branch 14a comprises two elongated slots 43 in which are engaged bolts or rods 44 which serve to guide branch 14a when the inclination thereof is varied.

Screws 42 cooperating with nuts 46 make it possible to displace branch 14a which is maintained by screws 47 passing in ovalized holes.

FIG. 4 represents an embodiment in which the branches 14a and 14b of the support have a width greater than that of the rammers, with the result that the side elements 21a may be displaced downwardly and side elements 24a to the left in the drawing in order to adjust the width of the rammers to the height of the slopes.

Rammers of different widths have been shown in broken lines in FIG. 4.

Branch 14b bears at its end opposite branch 14a a guide shoe 48 which abuts on the layer of the embankment and which serves to guide the positioning of the rammers on the embankment to be compacted.

Reference 49 represents two threaded rods which are connected by swivel joints respectively to side elements 19b and 22b and which are connected together by an elastic buffer 50.

Figure 5:
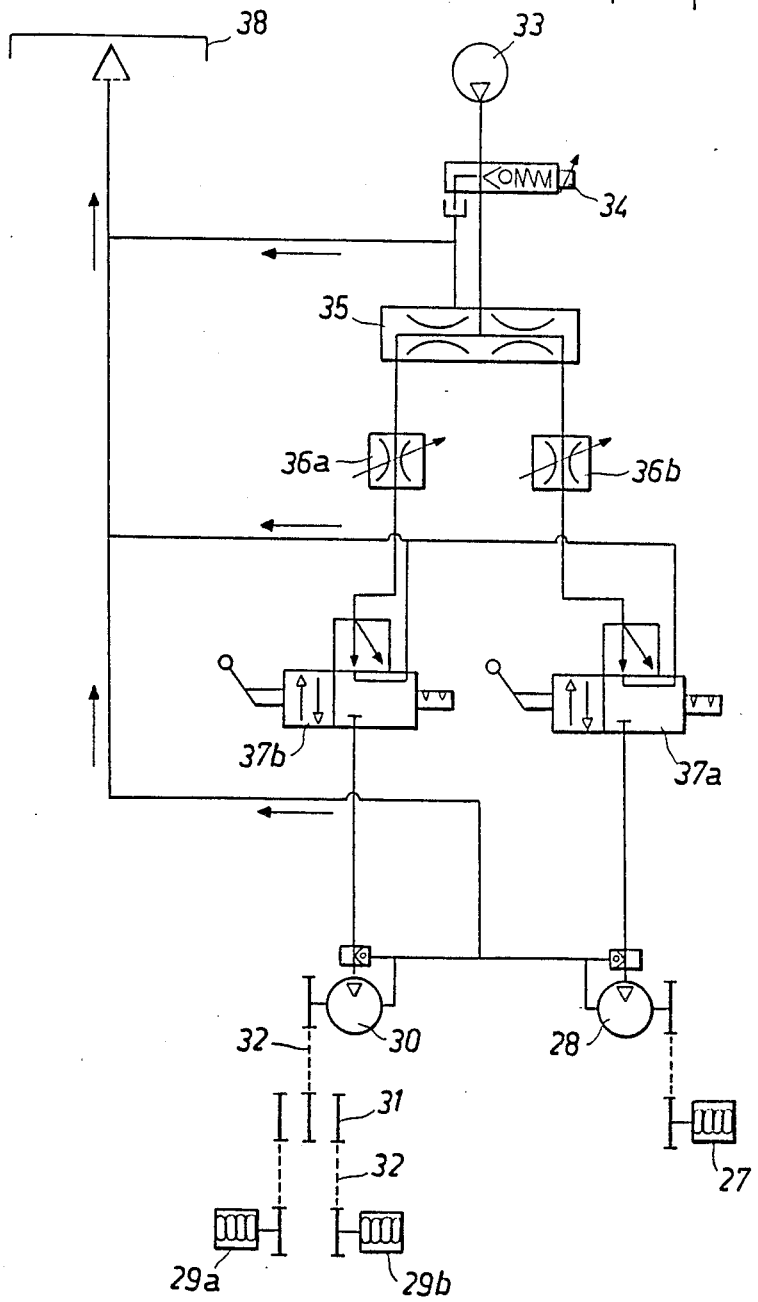
FIG. 5 is a diagram of the hydraulic circuits supplying the vibrating rammers of a machine according to the invention.

FIG. 5 is a diagram of the hydraulic circuits of a device according to the invention. This Figure shows the vibrator 27 of the inclined rammer which is driven by the hydraulic motor 28 and the two vibrators 29a and 29b of the horizontal rammer which are driven by the hydraulic motor 30 via pulleys 31 and synchronous belts 32.

Reference 33 represents a hydraulic pump. The oil delivered by the pump passes through a pressure-regulating valve 34. Reference 35 represents a flow divider unit. References 36a and 36b represent two flow regulator valves. References 37a and 37b represent two manually controlled hydraulic distributors. Reference 38 represents the oil reservoir.

The vibrators 27, 29a, 29b are vibrators with adjustable eccentric flyweights. By adjusting the eccentricity, the amplitude of the vibrations is adjusted.

The flow regulator valves 36a and 36b make it possible to adjust the speed of rotation of the motors 28 and 30 and to adjust the frequency of the vibrations as a function of the nature of the embankment. The slide distributors 37a and 37b are fitted with a discharge valve calibrated to 110 bars.

The vibrating rammers or the self-propelled machine bearing them may be guided mechanically for example by a guide shoe such as shoe 48, or by other equivalent guiding means for example by laser ray or from the peak of the slope of the preceding layer.

What is claimed is:

1. A process for constructing structures, such as dams, of a compacted material composed of an embankment mixed with a hydraulic binder comprising the following steps:

spreading successive horizontal layers of said material, each having a lateral slope, leveling and compacting each horizontal layer by means of a compactor which rolls over said horizontal layer, and simultaneously compacting the lateral slope of each layer and a horizontal strip parallel to the upper edge of said lateral slope by means of two vibrating rammers, an inclined vibrating rammer which compacts said slope over the whole height of said layer and a horizontal vibrating rammer which compacts said horizontal strip over the whole of the width thereof.

2. The process of claim 1, wherein said rammers are fastened to an arm or a boom of a self-propelled machine which moves parallel to the upper edge of said slope.

3. The process of claim 2, wherein said arm or boom comprises means for returning it horizontally towards said machine and, after having brought the two rammers close to a natural, non-compacted slope, said arm is returned towards said machine in order to push the materials and pack them inside the dihedron included between the two rammers, this making it possible to obtain a slope having an inclination greater than that of the natural slope and a regular upper edge and to construct structures of which the lateral walls present inward shoulders in the form of steps.

4. Structure of a compacted material which is composed of embankment mixed with a hydraulic binder and which is made by the process of claim 1, wherein it comprises slopes which have an inclination greater than an earth slope of said embankment and which earth slopes are obtained solely by compacting said material.

5. Structure of a compacted material made by the process of claim 3, and which is composed of an embankment mixed with a hydraulic binder and which comprises slopes which have an inclination greater than the earth slope of said embankment and which are obtained solely by compacting said material and which further comprises walls whose average inclination is greater than the earth slope of said embankment and which present shoulders in the form of steps having a regular, rectilinear, upper edge.

6. The structure of claim 4 obtained by the process of claim 3, wherein it comprises walls whose average inclination is greater than the earth slope of said embankment and which walls present shoulders in the form of steps having a regular, rectilinear, upper edge.

7. A machine for constructing structures formed by a plurality of superposed layers of a compacted material composed of an embankment mixed with a hydraulic binder, which machine comprises a self-propelled chassis adapted to move on said embankment which is equipped with a pivoting turret bearing an articulated arm or a boom and which bears a support articulated to the end thereof, which support is composed of two branches, one horizontal branch and an inclined branch, each branch bearing a vibrating rammer which simultaneously compacts, respectively, a horizontal strip located along the upper edge of the slope of each layer and said slope.

8. A machine as claimed in claim 7, wherein said inclined branch is mounted on said support so that the angle between said horizontal branch and said inclined branch may be varied to make it possible to adjust the inclination of said inclined branch and the final inclination of each slope.

9. The machine of claim 7, wherein the two branches of said support are orientable with respect to each other.

10. The machine of claim 7, wherein said vibrating rammers are fastened to said support via damper buffers.

11. The machine of claim 7, wherein said rammers are vibrated by rotating vibrators with eccentric flyweights and the machine comprises means for adjusting the eccentricity of said flyweights and the speed of rotation of said vibrators which make it possible to adjust the amplitude and frequency of the vibrations as a function of the nature of the material to be compacted.

12. The machine of claim 11, wherein it comprises hydraulic motors which rotate said rotating vibrators by means of pulleys and synchuonous belts.

* * * * *